US006302202B1

(12) United States Patent
Moore

(10) Patent No.: US 6,302,202 B1
(45) Date of Patent: Oct. 16, 2001

(54) INFLATABLE PLUG ASSEMBLY FOR BOREHOLE

(76) Inventor: Gregory James Moore, P.O. Box 114, Muswellbrook 2333 NSW (AU)

( * ) Notice: Subject to any disclaimer, the term of this patent is extended or adjusted under 35 U.S.C. 154(b) by 0 days.

(21) Appl. No.: 09/493,556

(22) Filed: Jan. 28, 2000

(51) Int. Cl.[7] ..... E21B 33/127
(52) U.S. Cl. ..... 166/187; 166/373
(58) Field of Search ..... 166/187, 192, 166/195, 386, 387, 373

(56) References Cited

U.S. PATENT DOCUMENTS

| | | | | |
|---|---|---|---|---|
| 3,918,520 | | 11/1975 | Hutchison . | |
| 3,995,694 | * | 12/1976 | Freiburger | 166/285 |
| 4,609,042 | * | 9/1986 | Broadus et al. | 166/187 |
| 4,846,278 | | 7/1989 | Robbins . | |
| 5,392,853 | * | 2/1995 | Toon | 166/187 |
| 5,441,302 | * | 8/1995 | Johnson et al. | 280/736 |
| 6,073,592 | * | 6/2000 | Wood et al. | 166/187 |

FOREIGN PATENT DOCUMENTS

| | | | |
|---|---|---|---|
| B-30436/92 | | 12/1992 | (AU) . |
| 1159524 | * | 7/1967 | (GB) . |
| 2262757 | * | 6/1993 | (GB) . |

OTHER PUBLICATIONS

Senior Inspector of Coal Mines—Jadefoil 'Wombat' Gasbags 1 page Mar. 20, 1998 Department of Mineral Resources.
Jadefoil—Hazchem Sheet 1 page Mar. 1998 Published Mar. 1998.
Jadefoil—Splash Bags for Wet Blastholes, Brochure 2 pages produced Nov. 1999 Published Feb. 2000.
Jadefoil—Your Answer to Improved Blasting, Brochure 2 pages produced Jul. 1999 Published Nov. 1999.
Mintech Gasbags, Brochure 2 pages ?? Available to Jadefoil.

* cited by examiner

*Primary Examiner*—Frank Tsay
(74) *Attorney, Agent, or Firm*—Gary Baker, Esq.

(57) ABSTRACT

An inflatable plug assembly suitable for use in the plugging of boreholes. The plug assembly having quick and slow inflation working modes selectable by the operator. The slow inflation working mode is obtained by orientation of the plug assembly such that the gas phase of the expandable working fluid is released on actuation by the operator. The quick inflation working mode is obtained by orientation of the plug assembly such that liquid phase expandable working fluid is released on actuation by the operator.

10 Claims, 1 Drawing Sheet

INFLATABLE PLUG ASSEMBLY FOR BOREHOLE

BACKGROUND OF THE INVENTION

1. Field of the Invention

This invention relates generally to plug assemblies and more particularly, to inflatable plug assemblies for boreholes.

2. Description of Related Art

Boreholes are drilled for the purpose of delivering an explosive charge to a selected location in, for example, an underground earth structure. The setting of the explosive charge often requires the borehole to be blocked so that the charge can be set at a desired level. Boreholes often tend to at least partially fill with water and the presence of the water can prevent successful detonation of the explosive. In attempts to overcome this problem, water proof explosives have been used. However such explosives are expensive in comparison to other explosives.

Furthermore, it is often the case that more than one explosive charge needs to be used with the explosives being positioned at spaced intervals along the borehole. This requires that the borehole plugs or other decking be placed at the selected depths along the borehole. The types of decking which have been used in the past include the application of a column of concrete or the like to a section of the borehole to space the explosive charges. Another system employs wooden, concrete or other types of discs with similar cross-sectional dimensions to the borehole which are lowered into the borehole so that they float on the surface of water within the borehole. It has also been proposed to use flexible polyester resins which float on the water and subsequently solidify. A further device which has been used comprises an inflatable plug with a time delay mechanism to allow inflation of the plug at a selected depth to thereby plug the borehole. More recently, a gel or slurry explosive has been used to replace the typical decking. Each of the above techniques suffers from certain disadvantages. Timber or concrete decking are cumbersome and generally not sufficiently reliable. Polyester resins are difficult to handle and slow to place. Internally inflated borehole plugs of the type described in U.S. Pat. No. 5,346,005, wherein a time delay mechanism permits the inflating plug to be lowered before inflation occurs may experience freezing of the time delay liquid and do not offer a ready delay time option.

SUMMARY OF THE INVENTION

It is an objective of this invention to provide inflatable plug assemblies having a simple, reliable and inexpensive means to select a quick or a slow inflation time by choice of plug orientation by the operator at the time of plug assembly insertion into a borehole.

In a particular embodiment of the invention, the pressurized container within an inflatable main body of the plug assembly may release working fluid slowly as a gas when triggered in an orientation wherein the working fluid liquid phase is away from the discharge outlet resulting is slow inflation of the plug assembly. Alternately, in this embodiment, working fluid mass is released quickly as a liquid when the pressurized container is triggered in an orientation wherein the working fluid liquid phase is adjacent to the discharge outlet resulting in quick inflation of the plug assembly. Inflation time of the plug assembly may be controlled, for example, from one to five minutes by choice of plug assembly orientation at the time of actuation and passage into a borehole for placement. The mechanism being reliable and inexpensive due to simplicity.

In a preferred embodiment, an elongate pressure container is fixedly mounted to the interior of the main body, the working fluid being discharged at a controlled rate, whether as gas phase or liquid phase, through a restriction orifice. In a more preferred embodiment, the working fluid is a gas at atmospheric pressure and ambient temperatures but existing at least partially as a liquid in the untriggered pressurized container. In a most preferred embodiment, the working fluid consists of tetrafluoroethane, propane, butane, or a mixture of these gases.

In a preferred embodiment, the main body has an internal chamber lined with a flexible bag composed of one or more gas impermeable layers. In a most preferred embodiment, the selection of plug assembly orientation, and thus inflation time, is by choice of alternate line attachment eyelets for lowering the plug assembly into a borehole; the attachment eyelets being mounted to opposing ends of the main body in fixed relation to the pressurized container.

The method of using the plug assembly being the steps of selecting a time delay working mode for the plug assembly, orienting the pressure container appropriately for the selected mode, operating the actuator to cause discharge of pressurized working fluid from the pressure container to the internal chamber, passing the plug assembly along the borehole to a location where inflation of the main body fixes the plug assembly within the interior of the borehole.

BRIEF DESCRIPTION OF THE DRAWINGS

The drawings include full views of a plug assembly and close up views of a pressurized container showing orientations for two modes of operation.

DESCRIPTION OF PREFERRED EMBODIMENTS OF THE INVENTION

Figure 1:
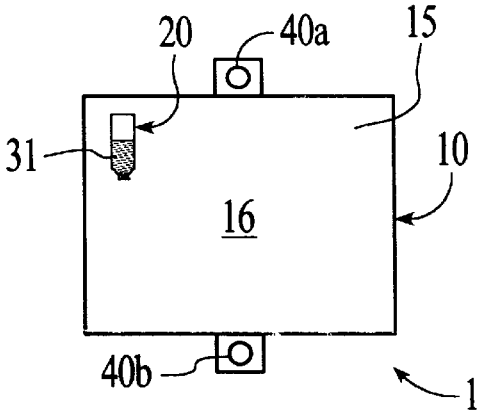
FIG. 1 is a schematic side elevation of a plug assembly according to the invention in a quick inflation mode of operation.
Figure 3:
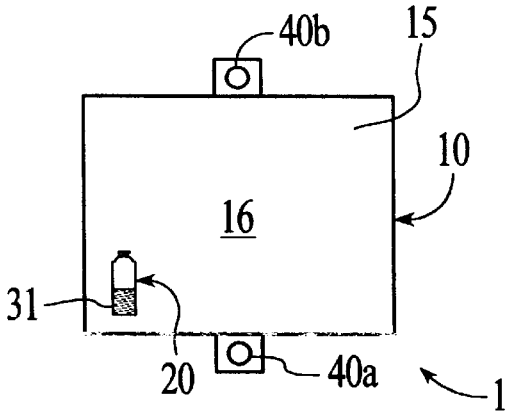
FIG. 3 is a side elevation of the plug assembly shown in FIG. 1 but in an alternate slow inflation operating mode.
Figure 2:
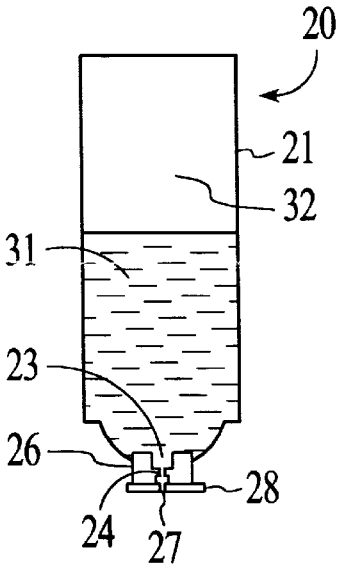
FIG. 2 is a close up cross-sectional view of the pressurized container shown in FIG. 1.
Figure 4:
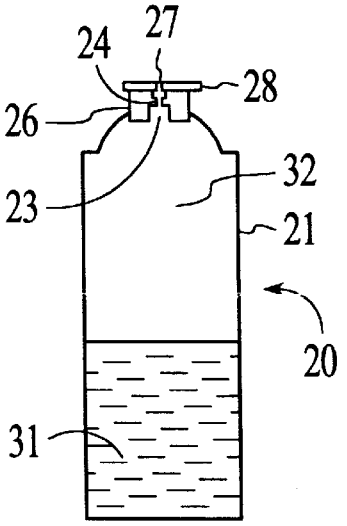
FIG. 4 is a close up cross-sectional view of the pressurized container shown in FIG. 3.

According to one aspect of the present invention, there is provided a plug assembly 1 which is suitable for use in the plugging of boreholes, the assembly including an inflatable main body 10 having an internal chamber 15 therein and a pressurized container 20 operatively mounted to the main body 10. The pressurized container 20 in the form of an elongated cylinder 21 having a discharge outlet 23 at one end thereof. The discharge outlet 23 sealed with an actuator 26 which is operable to cause the discharge outlet 23 to adopt an open position, the discharge outlet 23 being on fluid communication with the internal chamber 15 of the main body 10. The pressurized container 20 contains an expandable working fluid therein which is pressurized so that the working fluid within the pressurized container 20 includes a liquid phase 31 and a gas phase 32, each of which partially fill the pressurized container 20. The plug assembly 1 is capable of adopting a plurality of working modes including one working mode having the liquid phase 31 of the working fluid within the pressurized container 20 adjacent to the discharge outlet 23 and in another working mode of operation having the gas phase 32 component of the working fluid adjacent to the discharge outlet 23. The arrangement is such that upon operation of the actuator 26 to cause the discharge outlet 23 to adopt the open position, the working fluid is permitted to pass into the internal chamber 15 of the main body 10 causing the main body 10 to inflate. Such inflation in a borehole pressing the main body 10 against the borehole wall for an effective fluid seal plug of the borehole.

According to another aspect of the present invention there is provided a method of plugging a borehole using a plug assembly as described above. The method including the steps of selecting a working mode for the plug assembly 1, orienting the plug assembly 1 with the fixedly mounted pressurized container 20 appropriately, operating the actuator 26 to cause the discharge outlet 23 to adopt its open position and passing the plug assembly 1 along the borehole to a location where the plug assembly 1 is fixedly positioned as a result of inflation of the main body 10.

It will be appreciated that the time taken to inflate the main body will vary depending on the working mode selected. When a quick inflation mode is selected by orienting the plug assembly 1 for passage into the borehole with the liquid phase 31 of the working fluid adjacent to the discharge outlet 23, the working fluid will expand relatively quickly with the discharge outlet 23 in the open position causing a quick inflation of the main body 10. In this quick inflation mode, the liquid phase 31 of the working fluid is released from the pressurized container 20 directly through the discharge outlet 23 to expand quickly in the relatively low pressure of the internal chamber 15 of the main body 10. When a slow inflation mode is selected by orienting the plug assembly 1 for passage into a borehole with the gas phase 32 of the working fluid adjacent to the discharge outlet 23, the working fluid 30 will expand relatively slowly with the discharge outlet 23 in open position causing a relatively slow inflation of the main body 10. In the slow inflation mode, the liquid phase 31 of the working fluid must expand slowly to gas phase 32 within the pressurized container 20 prior to passing through the discharge outlet 23.

Preferably, the pressurized container 20 of the present invention is secured to the main body 10 in a substantially fixed relative position. More preferably, the pressurized container 20 is secured to the internal wall 16 of the internal chamber 15. Preferably, the pressurized container 20 is elongate with the discharge outlet 23 at one end. In a most preferred embodiment, line attachment eyelets 40*a* and 40*b* for lowering the plug assembly 1 into a borehole are mounted at opposite ends of the plug assembly 1 in operative orientation relative to the fixedly mounted pressurized container 20 such that selection of working mode orientation is accomplished by selection of one eyelet 40*a* or the other eyelet 40*b* for line attachment.

The pressurized container 20 can be formed from any suitable material such as metal or plastics and can be pressurized to any desired pressure such as, for example, 22 psi (150 kPa) to 90 psi (600 kPa).

The pressurized container 20 may include a restricting orifice 24 at the discharge outlet 23. Discharge time in quick or slow inflation mode may be further controlled by the size of the discharge orifice in cooperation with the orientation control mechanism of this invention.

The actuator 26 may comprise a pressure seal 27 to contain pressurized working fluid 30 in storage and a trigger 28 means for breaking the pressure seal 27 opening the discharge outlet 23 to release working fluid for expansion. Preferably, the actuator trigger 28 includes a locking means to hold the open position for full release and expansion of the working fluid.

The working fluid can be any suitable compressible fluid which may exist in both liquid and gas phase within the pressurized container. Working fluid may be in the form of compressed hydrocarbons, such as propane and butane, or a mixture of compressed hydrocarbons. Preferably, the working fluid is in the form of compressed refrigerant gases such as R134a (substantially tetrafluoroethane).

The main body 10 of the plug assembly 1 may be in the form of an inflatable flexible bag member which is gas tight. The main body 10 may include one or more layers of material and may be fabricated from materials such as rubber, elastomers, "Nylon"/"Surlon" coextrusions, polyester, polyethylene, polypropylene, polyethylene/"Nylon" extrusions, or metallic plastic films having suitable strength and low gas permeability. The exterior surface of the main body 10 preferably has sufficient toughness to prevent damage during lowering into a borehole and may have a texture which provides sufficient frictional grip to hold the main body 10 fixed against the wall of the borehole when inflated. Typically, the main body 10 is able to withstand and maintain an internal chamber pressure of from 1.5 psi (10 kPa) to 53 psi (350 kPa) in use.

The invention claimed is:

1. A plug assembly suitable for use in the plugging of boreholes comprising an inflatable main body having an internal chamber therein, a pressurized container operatively mounted to the main body, the pressurized container having a pressurized working fluid existing as a liquid phase component and a gas phase component, the pressurized container having a discharge outlet in fluid communication with the internal chamber, the discharge outlet having an actuator operable to seal or open fluid communication of the discharge outlet with the internal chamber, the plug assembly capable of adopting alternate working modes including one working mode in which the liquid phase of the working fluid is adjacent to the pressure container discharge outlet and a second working mode in which the gas phase of the working fluid is adjacent to the pressure container discharge outlet, wherein operation of the actuator to an open position releases pressurized working fluid through the discharge outlet into the internal chamber causing inflation of the main body.

2. A plug assembly according to claim 1 further comprising a discharge outlet having a restricted orifice through which working fluid is discharged to the internal chamber at a controlled rate.

3. A plug assembly according to claim 1 further comprising a pressure container having a generally elongate shape with the discharge outlet at one end.

4. A plug assembly according to claim 1 having the pressure container mounted to the interior wall of the internal chamber in a fixed orientation to the main body.

5. A plug assembly according to claim 1 wherein the alternate working modes are affected by orientation of the plug assembly after operation of the actuator to release working fluid.

6. A plug assembly according to claim 5 wherein alternate working mode orientation of the plug assembly may be selected by choice of alternate eyelets for line attachment.

7. A plug assembly according to claim 1 wherein the working fluid is a gas at atmospheric pressure and ambient temperatures but existing as a liquid on compression.

8. A plug assembly according to claim 7 wherein the working fluid is selected from the group consisting of tetrafluoroethane, propane, butane, or a mixture of two or more of the above.

9. A plug assembly according to claim 1 wherein the main body incorporates a inflatable flexible bag enclosing the internal chamber, the flexible bag including one or more layers of gas impermeable material.

10. A method of plugging a borehole using a plug assembly according to any preceding claim including the steps of selecting a working mode for the plug assembly, orienting the pressure container appropriately for the selected mode, operating the actuator to cause discharge of pressurized working fluid from the pressure container to the internal chamber, passing the plug assembly along the borehole to a location where inflation of the main body fixes the plug assembly within the walls of the borehole.

* * * * *